US009267258B2

(12) United States Patent
Knapp et al.

(10) Patent No.: US 9,267,258 B2
(45) **Date of Patent: *Feb. 23, 2016**

(54) MACHINERY FOUNDATION MODULE

(71) Applicants: Ryan W. Knapp, Sandy Hook, CT (US); Peter McGonagle, Southport, CT (US); Mark O'Donnell, Danbury, CT (US)

(72) Inventors: Ryan W. Knapp, Sandy Hook, CT (US); Peter McGonagle, Southport, CT (US); Mark O'Donnell, Danbury, CT (US)

(73) Assignee: THE MACTON CORPORATION, Oxford, CT (US)

( * ) Notice: Subject to any disclaimer, the term of this patent is extended or adjusted under 35 U.S.C. 154(b) by 36 days.

This patent is subject to a terminal disclaimer.

(21) Appl. No.: 14/139,163

(22) Filed: Dec. 23, 2013

(65) Prior Publication Data

US 2014/0270978 A1 Sep. 18, 2014

Related U.S. Application Data

(63) Continuation-in-part of application No. 14/085,489, filed on Nov. 20, 2013, now Pat. No. 9,126,607, which is a continuation-in-part of application No. 13/826,001, filed on Mar. 14, 2013, now Pat. No. 9,045,149.

(51) Int. Cl.
*B61J 1/04* (2006.01)
*E02D 27/44* (2006.01)

(52) U.S. Cl.
CPC ..... *E02D 27/44* (2013.01)

(58) Field of Classification Search
CPC ..... B61J 1/00; B61J 1/02; B61J 1/10; B60S 13/00; B60S 13/02
USPC ..... 104/35, 36, 44–48
See application file for complete search history.

(56) References Cited

U.S. PATENT DOCUMENTS

| | | | | |
|---|---|---|---|---|
| 1,772,858 | A * | 8/1930 | Coffey | 104/44 |
| 2,706,607 | A | 4/1955 | Withers et al. | |
| 5,016,338 | A | 5/1991 | Rowan, Jr. | |
| 5,149,050 | A | 9/1992 | Smith et al. | |
| 5,282,602 | A | 2/1994 | Zimmermann | |
| 5,491,944 | A | 2/1996 | Mors et al. | |
| 7,441,743 | B2 | 10/2008 | Behlinger et al. | |
| 7,798,067 | B2 | 9/2010 | Starnes | |
| 7,966,939 | B2 | 6/2011 | Holt | |
| 2007/0175353 | A1 | 8/2007 | Jeffs | |

* cited by examiner

*Primary Examiner* — R. J. McCarry, Jr.
(74) *Attorney, Agent, or Firm* — St. Onge Steward Johnston & Reens LLC

(57) ABSTRACT

An assembly for supporting machinery and a method for installing the same is disclosed. A frame module including: a base with at least one attachment location, the attachment location for receiving the machinery; and a plurality of frame members affixed to the base, wherein at least one of the frame members defines a plane corresponding to a wall. A foundation has first and second sections and is disposed around the frame module. A portion of the frame module is at least partially submerged within the foundation. The machinery has at least one flange for affixing the machinery to the foundation at the attachment location. The first section of the foundation is disposed below an outside surface of the base and the second section of the foundation defines the wall of the foundation.

25 Claims, 12 Drawing Sheets

MACHINERY FOUNDATION MODULE

FIELD OF THE INVENTION

This invention relates to heavy lifting and positioning machinery and the manufacture thereof for installation at a site. More particularly, this invention relates to improved railway hoist machinery and an improved method of installing the same.

BACKGROUND OF THE INVENTION

Heavy machinery is found in many factories, rail yards, repair shops and other locations where large items are moved and positioned. For example, lifting machinery is often required to repair rail cars, engines and other railway vehicles and machinery. The lifting machinery is often made up of large support structures using hydraulic pistons, screws or large motors to move machinery. Because of the size of the lifting machinery and the size of machinery to be moved, it is often advantageous to place the lifting machinery below ground level, typically in a foundation.

In the case of a rail car lifting or positioning machinery such as a repair stand or hoist, it is desirable that the gap between the rails on the ground and the rails on the positioning machine be minimized. The size of the foundation must match to the dimensions of the machinery so that the machinery can operate properly. A difficulty associated with minimizing gaps and rubbing is that the machinery sits in a foundation that is created using concrete forms that are often built from wooden boards and sheets. These forms are often cut and designed on site.

The machinery is often built from large steel plates and/or beams and machine elements that are cut and fit at the point of manufacture. Because the foundation and the machinery are built separately, the foundation often needs modifications when the machinery is installed on site to adjust the tolerances and gaps for ideal operation of the machinery within the foundation.

Current practice sometimes uses a number of foundation embedments to create complicated sections of a foundation. In order to properly locate each embedment, a number of variables may need to be properly surveyed or measured to allow for correct installation. Variables include, for example, center, center line, perimeter and depth of the foundation. Locating center alone is often a surveying task that can take a substantial amount of time to complete. Once center is located, a number of holes must be drilled in a flat section of the foundation so that anchor bolts can be installed. The anchor bolts affix the machinery to the foundation, and the pattern of the anchor bolts must be within tight tolerances so that the machinery can easily bolt to the foundation. Again, locating the center and setting the pattern of the bolts in relation to center or another point of reference can be a lengthy and costly surveying task.

Often, a general contractor responsible for pouring concrete has difficulties achieving the tolerances required for machinery to operate correctly within a foundation. Since the tolerance requirements are so high relative to what is often required of general contractors, locating center and bolt holes within a foundation is a time consuming and expensive process. Additional problems with tolerances of concrete pouring may require alterations to foundations after pouring, which are time consuming and labor intensive.

Additionally, current practice for installation of machinery may require that the machinery is installed in a partially completed foundation, and then the foundation is completed once the machinery is in place. Often, the first part of the foundation is poured, and then the general contractor leaves the job site because of the length of time required to install the machinery. Then the machinery is installed, and once installed, the general contractor is brought back to the job site to complete the foundation. This requires additional costs associated with re-mobilizing the general contractor's foundation pouring operations.

U.S. Pat. No. 5,149,050 to Smith et al. discloses a base pad for supporting heavy, vibrating machinery with minimal environmental pollution. This pad does not relate to a foundation having walls, and the machinery does not appear to operate within a foundation having walls. Further, there does not appear to be disclosure of bolts affixing to the foundation by passing through bolt holes in a base of a receiver.

U.S. Pat. No. 7,798,067 to Starnes discloses a thin turntable having bearings disposed between a ground-engaging member and a load-supporting platform. A motor support box is located below the ground engaging member, the motor support box housing the motor assembly. An intermediate load transfer unit having bearing elements is located between the ground-engaging member and the load-supporting platform. The ground engaging unit of Starnes does not contain the entire turntable. The ground-engaging member has load surfaces that interact with the bearings of the intermediate load transfer unit.

U.S. Patent Application Publication No. 2007/0175353 A1 to Jeffs discloses a vehicle turntable with a housing having rollers within the housing. The housing rollers contact and support the turntable member. The vehicle turntable is pre-assembled with the housing, and the housing is an integral part of the turntable's ability to turn. A module adapted to receive completed machinery is not disclosed.

U.S. Pat. No. 7,966,939 to Holt discloses a foundation having a circular trench with an inner ring and an outer ring mounted within the circular trench. The two rings have rollers affixed thereon, and a bar assembly rests on the rollers. The turntable is assembled onto the foundation after the foundation is poured. A module adapted to receive completed machinery is not disclosed.

There is a need for improved lifting and positioning machinery that overcomes the disadvantages of the prior art. Much of the prior art is directed towards avoiding the use of a foundation for machinery such as a turntable. Although avoiding the use of a foundation for some applications may be acceptable, a foundation is often necessary for heavy loads, because the machinery must be stiff enough to support the heavy load. This avoidance of foundations in the prior art shows a need for machinery having an improved installation method.

SUMMARY OF THE INVENTION

It is therefore an object of the present invention to provide a method of installation for machinery that reduces or eliminates the need for modifications to a foundation after the foundation material is cured or set.

It is further an object to provide an improved method of installation for machinery that is cost effective.

Still another object is to provide a method of installation for machinery that allows a foundation to be built with tighter tolerances than prior art methods.

These and other objects are achieved by providing an assembly for supporting machinery. A frame module may include: a base with at least one attachment location, the attachment location for receiving the machinery; and a plurality of frame members affixed to the base, where at least one of the frame members defines a plane corresponding to a wall. A foundation may have first and second sections. The foundation may be disposed around the frame module and a portion of the frame module is at least partially submerged within the foundation. The machinery may have at least one flange for affixing the machinery to the foundation at the attachment location. The first section of the foundation may be disposed below an outside surface of the base and the second section of the foundation defines the wall of the foundation.

In some cases each attachment location includes at least one hole for receiving a bolt there through to affix the machinery to the foundation. Further, this may include a machinery hole in the base, the machinery hole adapted to receive a portion of the machinery there through. Also, a pit may be below the machinery hole where at least a portion of the machinery is adapted to operate in the pit. In addition, a pit member could be disposed below the base and may extend towards a bottom of the pit to define a wall of the pit. The pit member may be cylindrical. The pit base may be disposed at a bottom end of the pit member. Further, a tensioning member having first and second ends may be attached to the frame module at the first end and the pit base at the second end.

Other objects are achieved by providing a device for installing machinery in a foundation. A base may have at least one attachment location where the machinery is adapted to affix to the foundation at one or more of the attachment locations. A plurality of frame members may be affixed to the base and adapted to at least partially submerge in the foundation, where at least one the frame members may include an edge defining a plane corresponding to a wall of the foundation. At least one machinery hole is located in the base where at least a part of the machinery may be adapted to insert into the machinery hole to allow part of the machinery to extend below the base.

In other aspects, the device may include a pit member disposed below the base and defining a wall of a pit where part of the machinery is adapted to insert into the pit. Further the attachment location may include a plurality of holes and the machinery may be affixed to the foundation by bolts passing through the holes. The plurality of holes may be disposed in a pattern around the machinery hole and spaced away from an edge of the machinery hole. The pit member may be cylindrical. A pit base may be disposed at a bottom end of the pit member. A tensioning member has first and second ends, the tensioning member is attached to the frame module at the first end and the pit base at the second end.

Other objects are achieved by providing a method of installing machinery including the step of providing a frame module defining an opening and sized to receive at least part of the machinery therein, the frame module including a plurality of attachment locations and at least one frame member for defining a wall. The method may further include excavating a hole in the ground, the hole sized to receive the frame module and pouring a foundation material so that the foundation material is disposed below the frame module and around the opening. The machinery may be affixed to the foundation at the attachment locations.

The method may include the frame module having at least one machinery hole and the method including the step of providing a pit member and securing the pit member below the machinery hole. The excavating step may include excavating the hole so that the hole is sized to receive the pit member. The pouring step may include pouring foundation material such as concrete or a backfill material or others around the pit member. Further, each attachment location may have at least one hole for receiving a bolt there through to affix the machinery to the foundation. In addition, the step of providing and securing a pit member may include one or more of: providing a pit base at a bottom end of the pit member; providing a tensioning member having first and second ends; attaching the tensioning member the frame module at the first end and the pit base at the second end; and/or tensioning the tensioning member to secure the pit member to the frame module. The step of pouring a foundation material may include pouring a first section of the foundation below and around the pit member and pouring a second section of the foundation between the first section and the base. The first and second sections may overlap.

In addition, the frame module may be provided with electrical wiring or electrical connections affixed thereto. Preferably, this wiring is installed at the factory producing the frame module to reduce installation time, however it is contemplated that wiring may be installed at another location. The wiring is used to operate the machinery, and the method may include the step of of connecting the machinery to the electrical wiring. Further, the machinery may include a plurality of motors, and the electrical wiring may include at least one connection for each of the plurality of motors. In addition, the wiring may include a releasable connection that allows for easier connection and disconnection of one or multiple columns from the electrical system. These releasable connections may be considered easier than directly splicing or joining wires to each other, which is an operation that could require specialized installation skills of an electrician. The use of the releasable electrical connections can help ensure that the machinery is properly installed and connected to the controller. Further, the connections may be designed so that there is only one way to connect the controller and the machinery, thus increasing the likelihood that the correct connections are made.

Further, a drain may be provided and affixed to the frame module. In some cases, the frame module may be provided with the drain already affixed thereto, and the method may include connecting the drain to an exterior drainage. The exterior drainage may be a sewer line, a storm drain or other channel or location that can allow for water to be removed from the foundation.

DETAILED DESCRIPTION OF THE INVENTION

Figure 1:
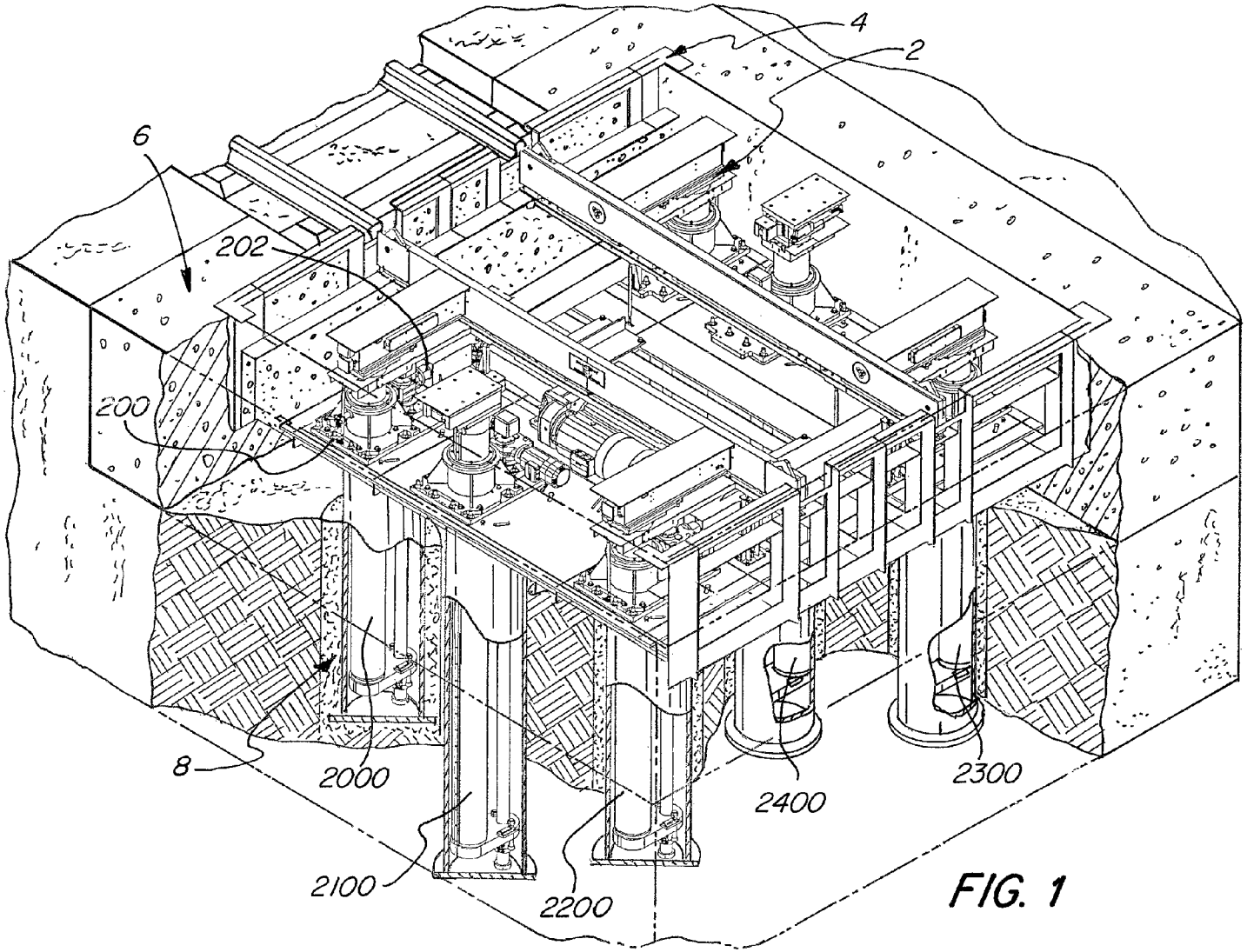
FIG. 1 is a perspective schematic cutaway view of machinery installed in a foundation according to an embodiment of the present invention.

In FIG. 1, machinery 2 is installed in a foundation 6 using a frame module 4 that may be sized to receive all or part of the machinery therein. The machinery includes flanges 200 and the frame module has attachment points that allow for bolts to affix the flange to the foundation. There are multiple levels or pits 8 below the frame module 4. These pits allow for part of the machinery to extend into the pit. As shown, the machinery includes rails for receiving a rail vehicle. The wall of the foundation may have two sections as shown that define a lip. As shown, the rail supports of the machinery can rest on the lip at the bottom position in order to support the load at the ends of the rails and to provide additional resistance to deformation.

Figure 2:
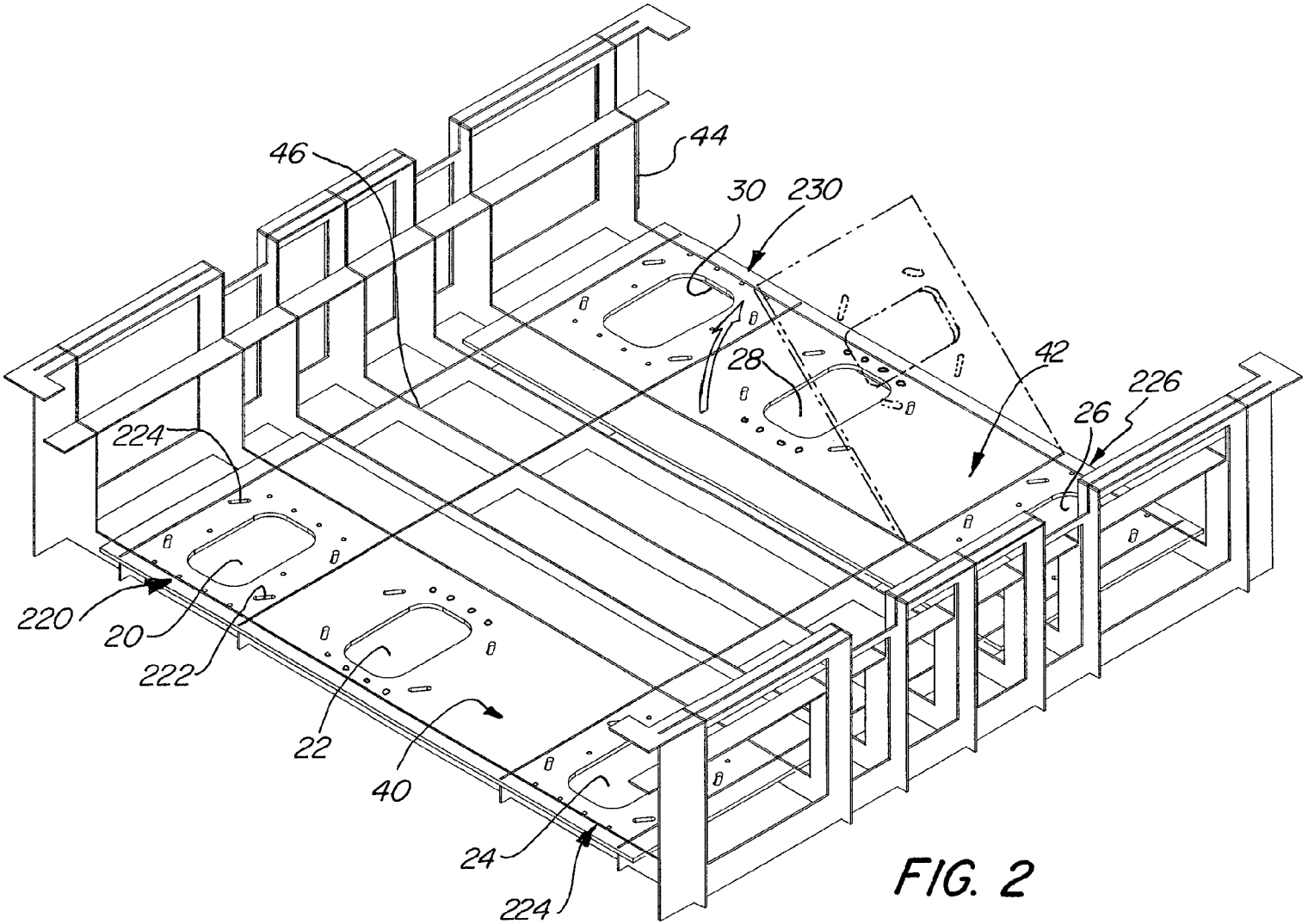
FIG. 2 is a perspective view of the frame module shown in FIG. 1

In FIG. 2, a number of attachment locations are shown, for example 220, 224, 230, 226. These attachment locations have holes arranged in a pattern around a machinery hole 20, 22, 24, 26, 28, 30 to receive bolts. The bolts receive the flanges of the machinery as shown in FIG. 1. Part of the machinery such as the columns 2000, 2100, 2200, 2300, 2400 extend into the respective machinery hole 20, 22, 24, 26, 28, 30. These columns may also move up and down as the machinery raises and lowers the rail cars. Plates 40 and 42 include the attachment locations therein, and these plates may be designed to be affixed to the base frame structure 46 after the foundation has been poured. This allows for access to the space below the base 40,42 for pouring concrete around the pit members shown in FIG. 3.

Since the frame module is typically designed for a specific type of machinery, electrical connections and conduit may be connected to the frame module 4 at the factory to allow for easy installation and repair of the machinery. The electrical connections will typically connect to a controller or control system that is used to operate the machinery. These connections may converge at a junction box or electrical panel that is attached to the frame members so that the junction box or electrical panel can be accessed. For example, a junction box or electrical panel may be placed along the top edge of the foundation frame so that the foundation is poured around the junction box or electrical panel, with one side of the box or panel showing to allow for connection of the controller. For example, the junction box or electrical panel may be placed so that it is partially submerged and embedded in the floor at track level. This allows for access to the junction box or electrical panel without an obstruction or hazard protruding from the the shop floor.

In some cases, the machinery has one motor associated with each column, therefore, the junction box would accept all electrical connections for each of the columns, with conduit and wiring individually running to each of the columns. Some of the connections may include connections to power motors, and connections to carry sensor signals. It would be understood to one of skill in the art that the electrical connections provided with the frame module would relate to the machinery being installed and thus other connection types are contemplated. Similar to the drain pipe system discussed in FIG. 4, the conduit and wiring can be pre-installed in the frame module to reduce the skill required to install the system on site. Since the wiring is located and connected by the factory, the on-site installers simply need to connect the electrical connections at each of the columns or motors upon installation of the machinery. This may eliminate the on-site step of routing wires and other connections to the machinery, which can greatly reduce installation time. Further, since the wiring may be done at the factory, it would be possible to verify that wiring was done correctly prior to shipment of the frame module and machinery.

The ends of the wiring may include releasable electrical connections to allow for easy disconnection and connection that requires reduced, limited or no knowledge from an electrician. Similarly, the junction box or panel may also include one or multiple releasable connections that are associated with the columns, motors, sensors and other controls, these releasable connections may be specific to a particular wiring pattern for the controller so that incorrect wiring is avoided. The junction box or panel may be located such that the controller can be connected thereto. Non-symmetrical plugs and sockets and different shaped connectors that are designed to be compatible with certain wiring schematics are contemplated in order to reduce the likelihood of incorrect wiring. If appropriate, other types of connections may be considered part of the "electrical connection," for example, an optical connection or others may be used, for example to transmit sensor signals as necessary.

The conduit for the electrical connections may be embedded in the foundation, or may be designed to be attached to the inner surface of the frame member 4. For example, the conduit may run along the top of base plates 40, 42. The conduit may also run along the frame members 46 or beneath the base plates 40, 42, different locations and combinations of orientations for the conduit and junction boxes are contemplated.

Figure 3:
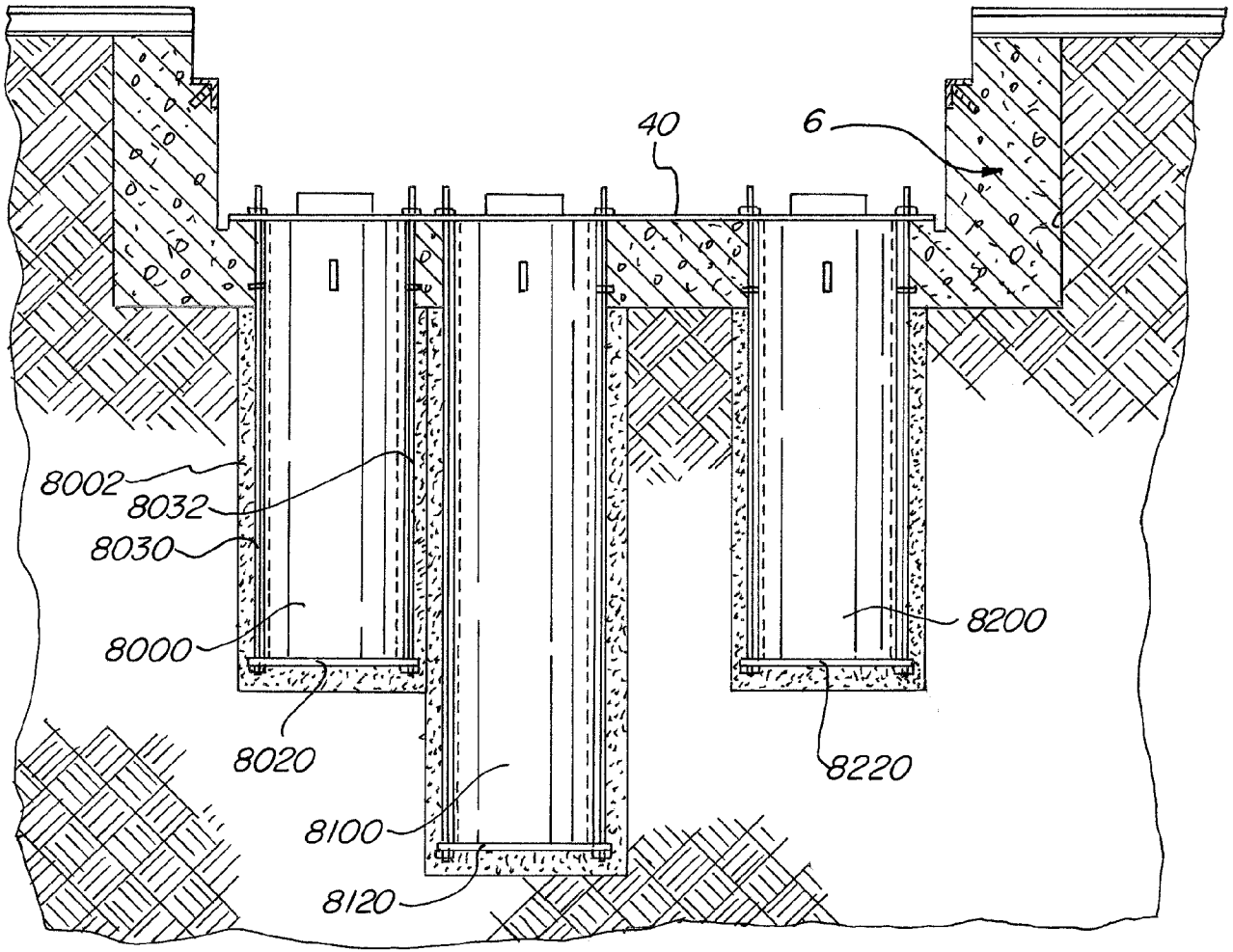
FIG. 3 is a side sectional view of the frame module of FIG. 1 installed in a foundation.

In FIG. 3, pit members 8000, 8100 and 8200 are shown below the base 40. These pit members may be cylindrical in shape, but may also be other shapes accommodated to receive the columns 2000, 2100, 2200, 2300, 2400 shown in FIG. 1. Tensioning members 8030, 8032 affix to a pit base 8020 and extend above the base through holes 222, 224. The tensioning members may be threaded so that a nut can be tightened to pull the pit base 8020 towards the base 40, thus securing the pit members 8000, 8100, 8200. It is contemplated that other securing systems may be used to secure the pit members to the base 40, for example, welding may be used. An additional flange can be welded to the pit members, the additional flange having holes therein to secure to the base 40 through the holes 222, 224. A back fill material such as gravel 8002 is shown around the outer surfaces of the pit member 8000 and the pit base. Other back fill materials such as sand, dirt, stone, concrete and combinations thereof may be used.

Figure 4:
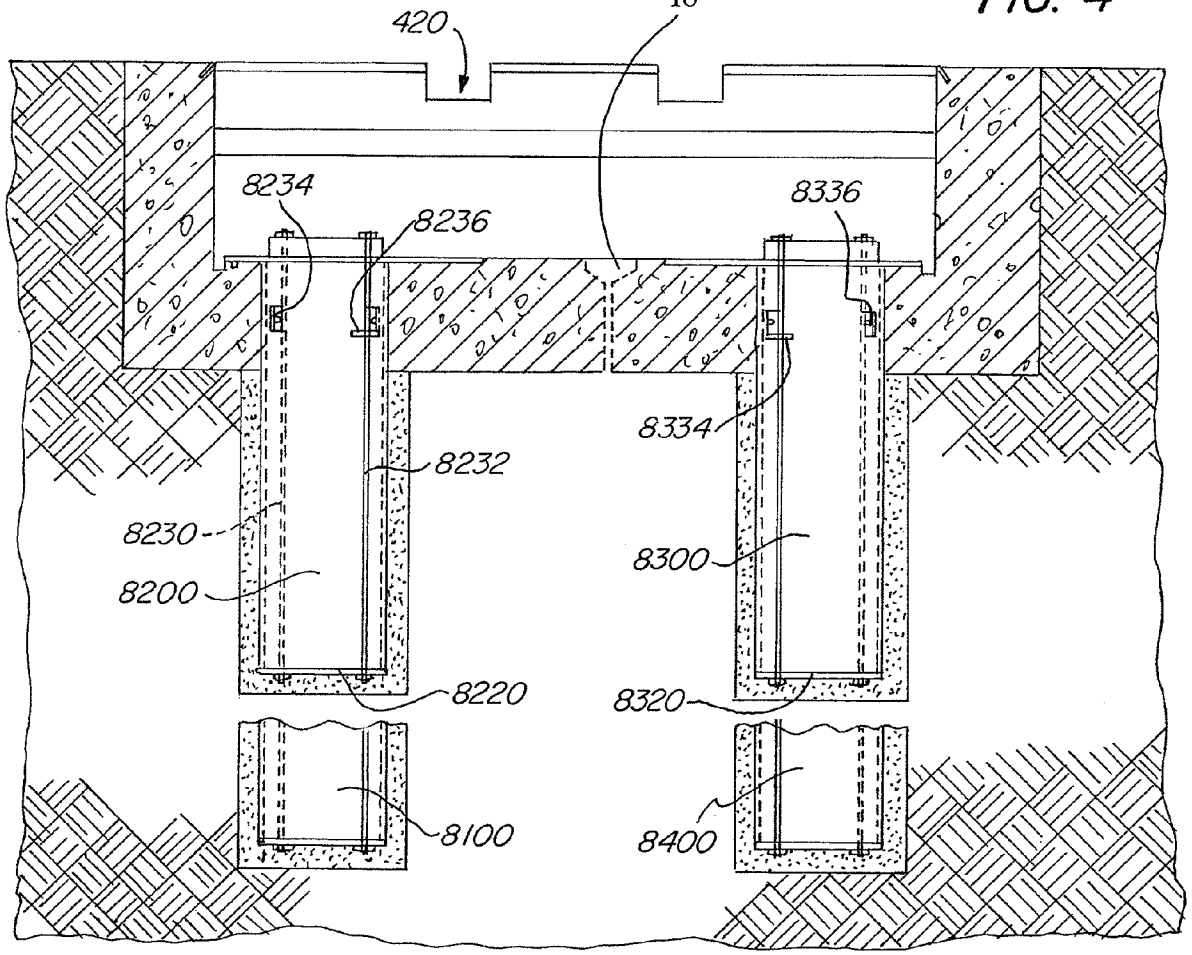
FIG. 4 is a front sectional view of the frame module of FIG. 1 installed in a foundation.

In FIG. 4, brackets 8234, 8236 extend from the pit member 8200, and the tensioning members 8230, 8232 pass through the brackets to align the tensioning members substantially parallel to the outer surface and/or the axis of the pit member. This ensures that while a back fill material is filled in around the pit member and pit base, the tensioning members remain properly aligned to pass through holes such as 222, 224 to affix the tensioning member, pit member and pit base to the outer surface of the base 40. The frame module 4 may have recesses 420 for receiving an incoming track or rail section. A drain 48 may be located within the foundation in order to avoid the accumulation of water within the foundation. The drain may be affixed to one of the frame members 46 so that when the foundation is poured, the drain is properly located. The addition of the drain to the frame members can make it less likely that the drainage system is omitted by mistake. The drain is connected to an exterior drainage such as a storm drain, sewer line or other location where water can flow to in order to drain the foundation of water. In order to prevent or reduce water flow into the pits, a water tight seal may be used when affixing the machinery flange to the foundation. This seal may be between the flange and the base plate, and may be, for example, a gasket, o-ring or other sealing systems or devices.

Figure 5:
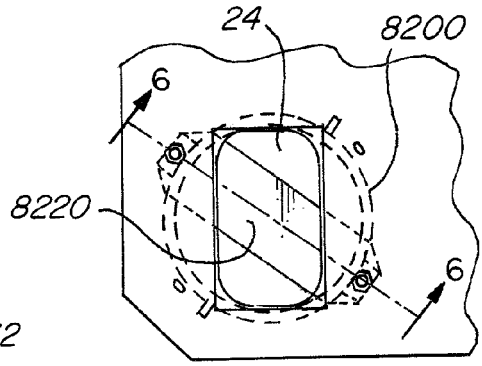
FIG. 5 is a top detail view of the frame module of FIG. 1.
Figure 6:
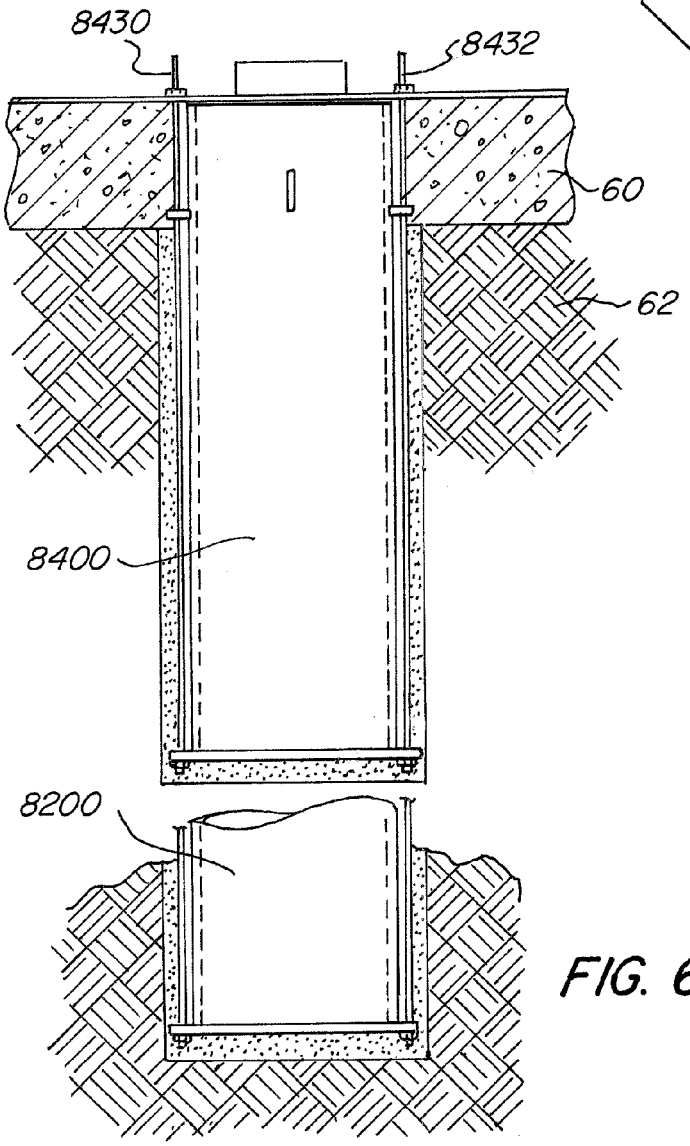
FIG. 6 is a sectional view along section line 6-6 shown in FIG. 5.
Figure 7A:
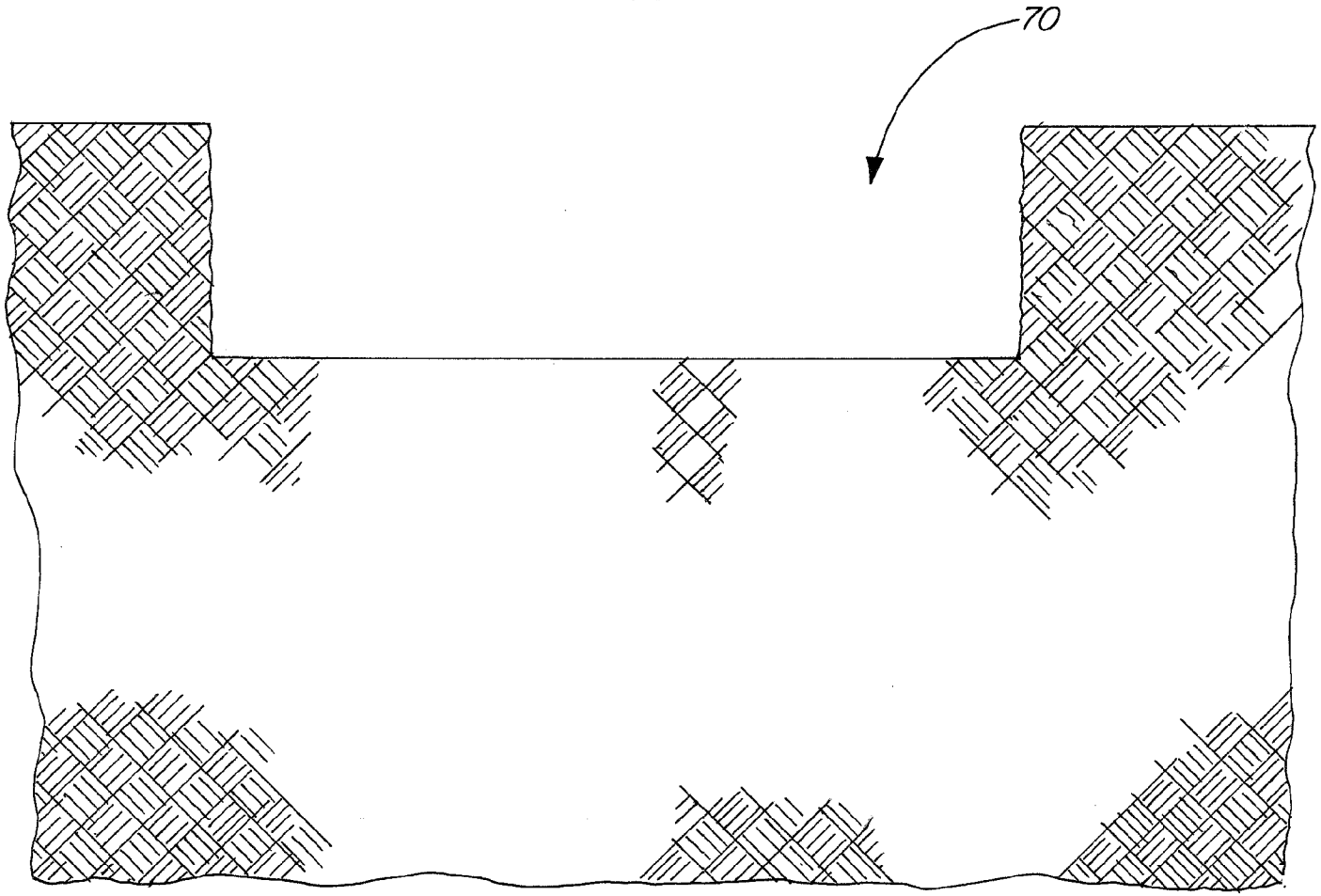
FIGS. 7A-7E are schematic representations of the installation method for FIG. 1.
Figure 7B:
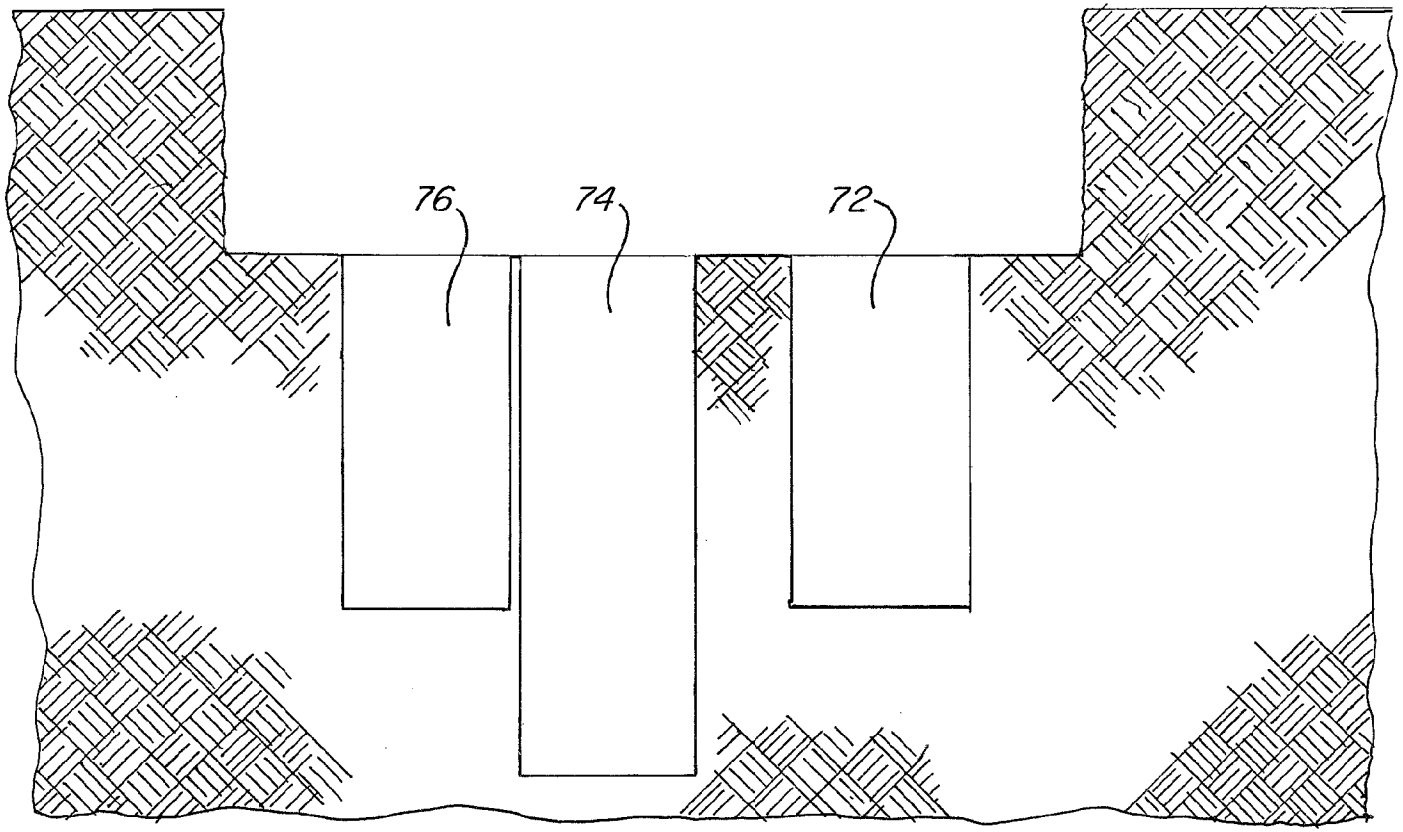
Figure 7C:
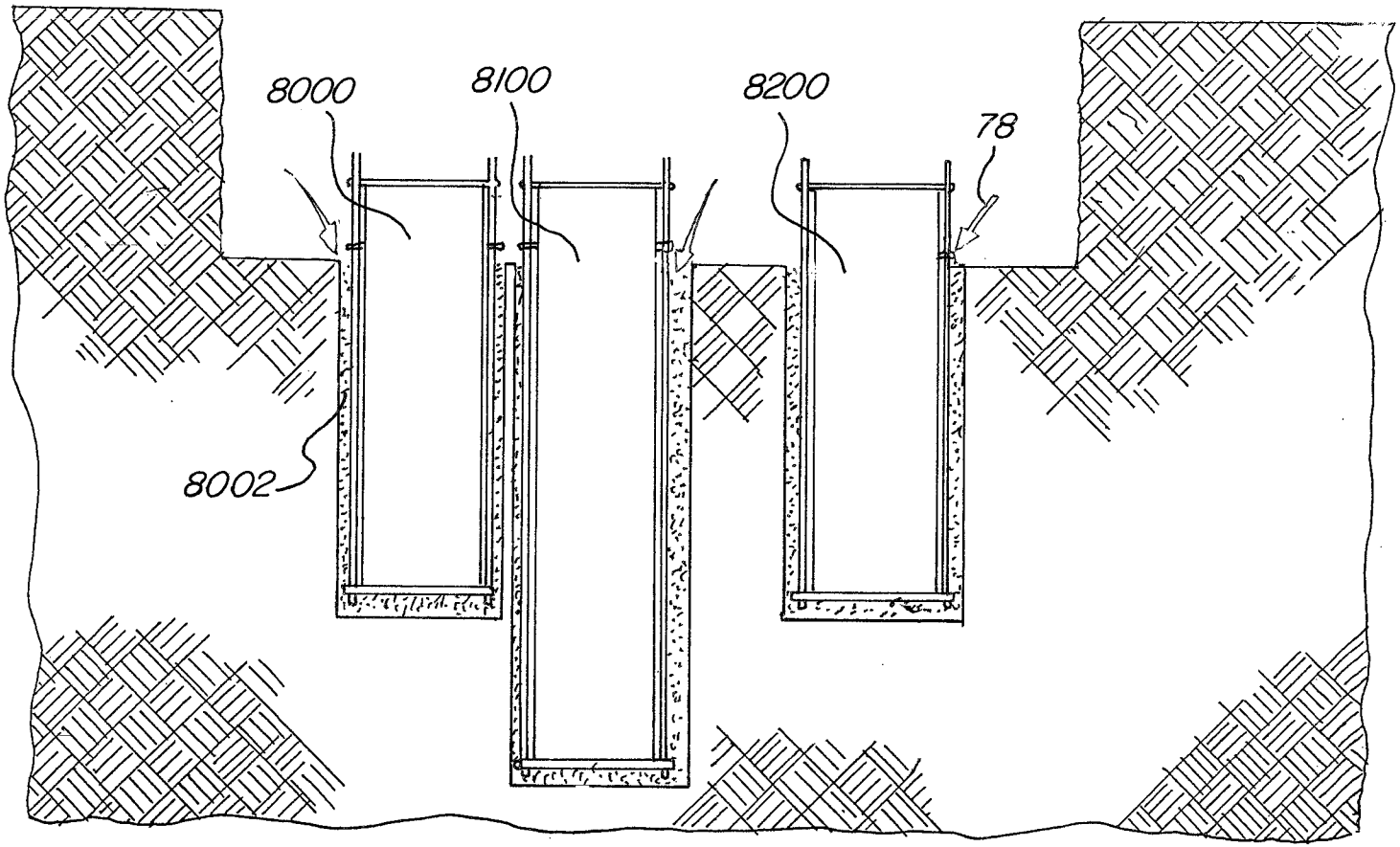
Figure 7D:
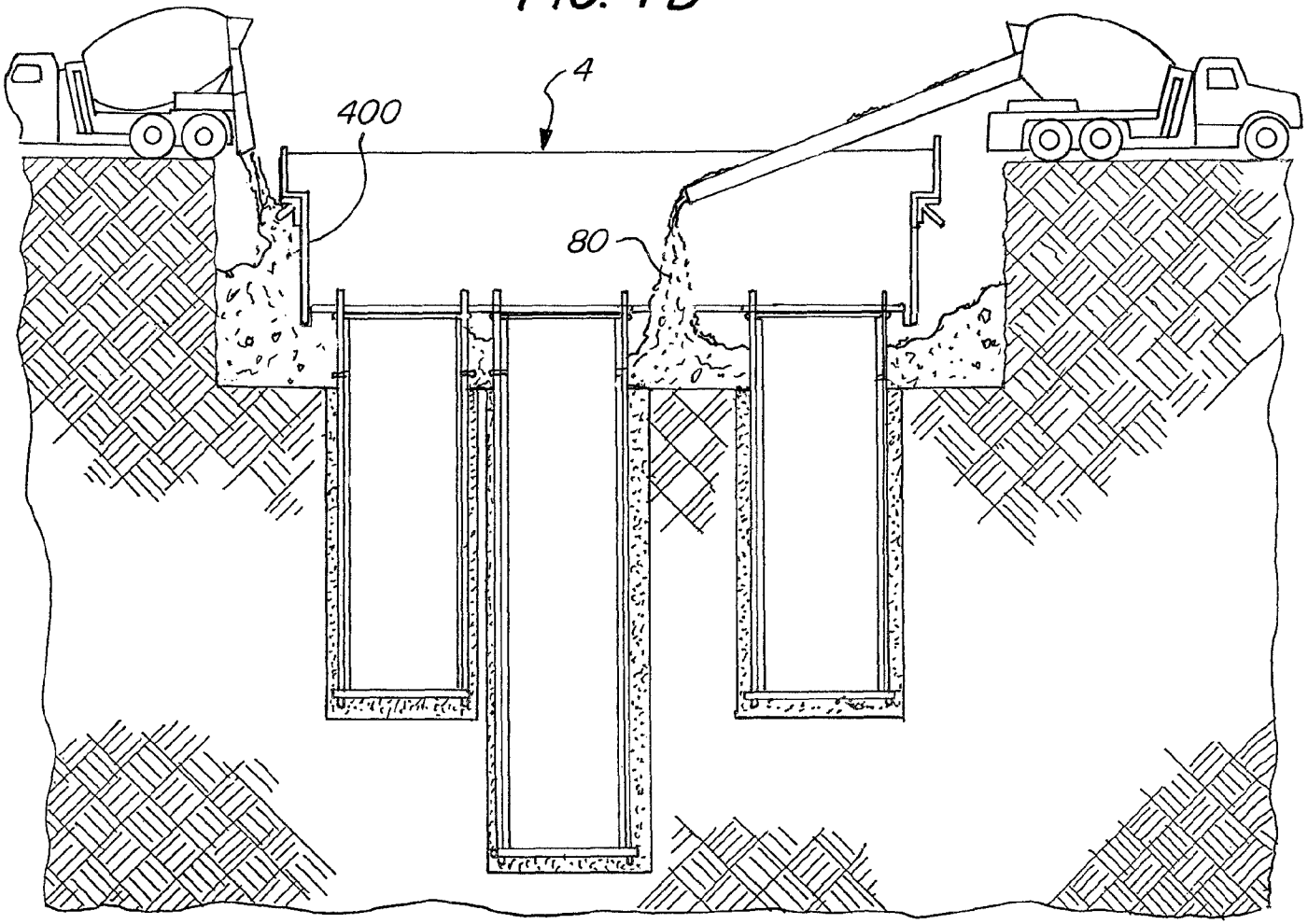
Figure 7E:
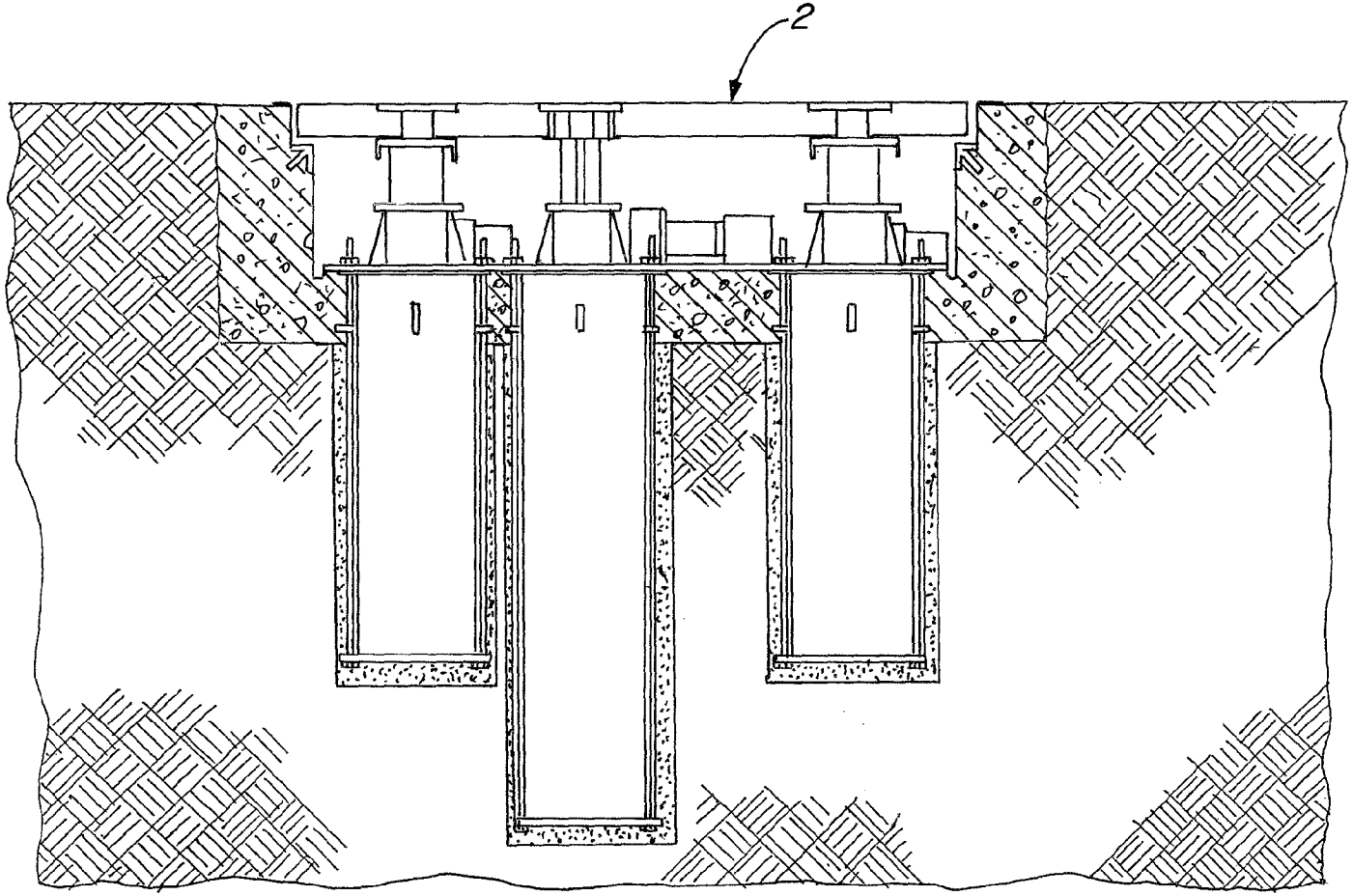

In FIGS. 5 and 6, machinery hole 24 is shown in the base 40. The pit member 8200 is located in a pit and the pit base 8220 along with the tensioning members 8234, 8236 secure the pit member assembly to the base 40. A seal such as foam, rubber or other may be located between and/or around the pit member and the bottom side of the frame, in some cases a seal may also be located between and/or around the pit member and the pit base, typically where the pit base covers the entire end of the pit member. The tensioning members may insert into the base of the frame through slotted holes. This may allow for adjustment of the positioning of the tensioning members to align properly with the machinery hole. As shown, the pit base 8220 does not cover the entire bottom end of the pit member. This may allow the pit to drain through the back fill material and the ground below. The pit member 8200 helps prevent the pit from caving in over time since the pit member defines the opening that the columns operate within. The pit member may be made of a number of materials. As an example, metals and plastics.

In FIGS. 7A-7E a schematic representation of a method of installing machinery is shown. A hole 70 is excavated and sized for the frame module 4. A number of holes 76, 74, 72 are bored or excavated in the ground for the pit members 8000, 8100, 8200. A foundation material 8002 for example a back-fill such as gravel, sand, stone, dirt and/or the like is poured 78 around the outer surface of the pit members. A foundation material 80 such as concrete is poured below and around the frame module 4. A form member 400 is secured to the frame module 4 in order to contain the concrete to the desired locations. In some embodiments, the frame module will be built with forms already affixed or permanently attached to the frame module. In some cases, the form members are removed and the machinery 2 is installed, typically by bolting the flanges of the machinery to the foundation through the holes 220 around the attachment locations. Although the figures are shown in an order 7A-E, it should be understood that the order of the steps can change depending on the characteristics of the machinery and/or the installation job. Further, some steps may be un-necessary, depending on the characteristics of the machinery.

In order to install the machinery in the completed foundation the section of the foundation below the attachment locations may be drilled according to the pattern of holes. A bolt may be inserted, bonded or affixed in the drilled holes, and the flange of the machinery can be attached to the bolts. It is also contemplated that the bolts can be inserted into the foundation material while or prior to curing. This may eliminate the step of drilling the holes according to the pattern of the attachment locations. Further, the bolts may be installed in the holes prior to installing the frame module in the excavated hole or prior to pouring the foundation material.

Figure 8:
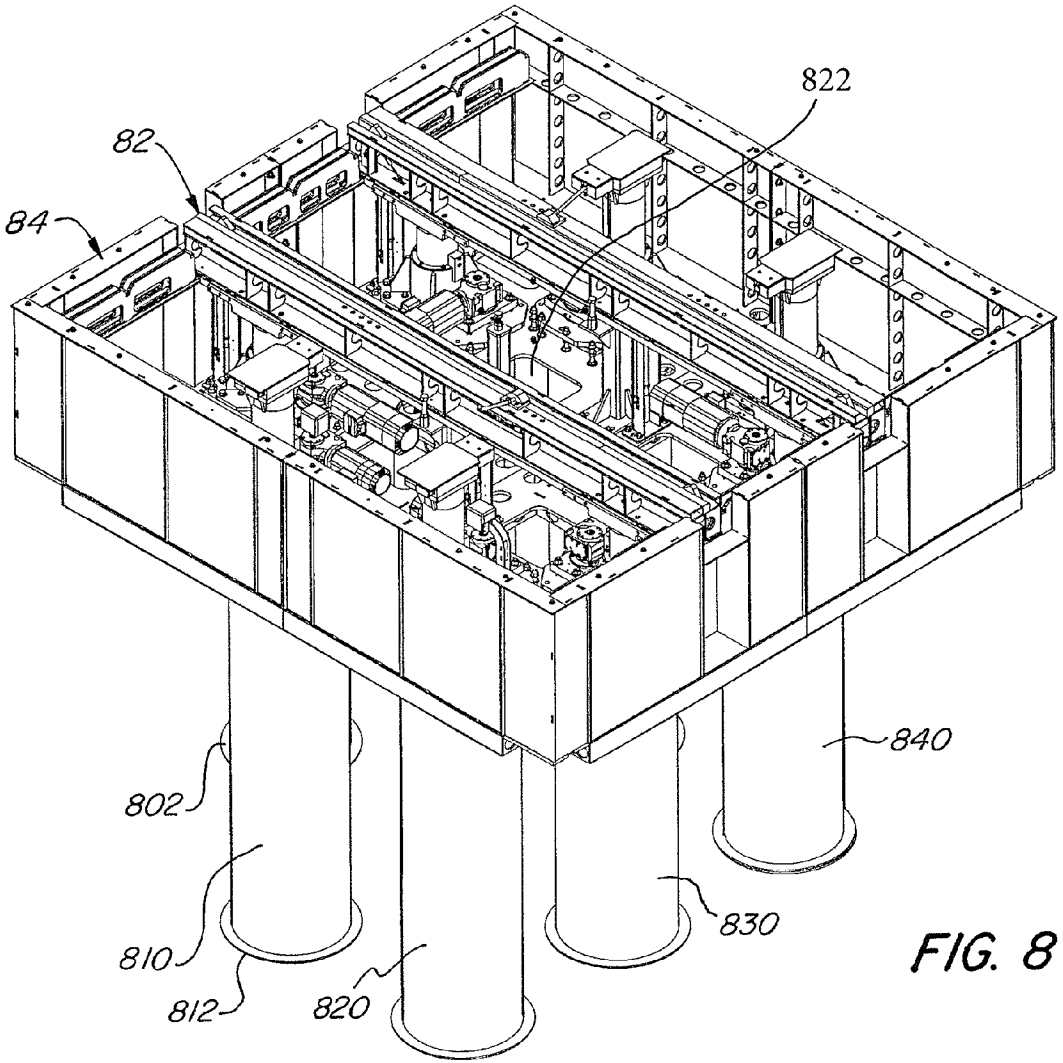
FIG. 8 shows an alternate embodiment of the frame module and machinery assembly similar to FIG. 1.
Figure 9:
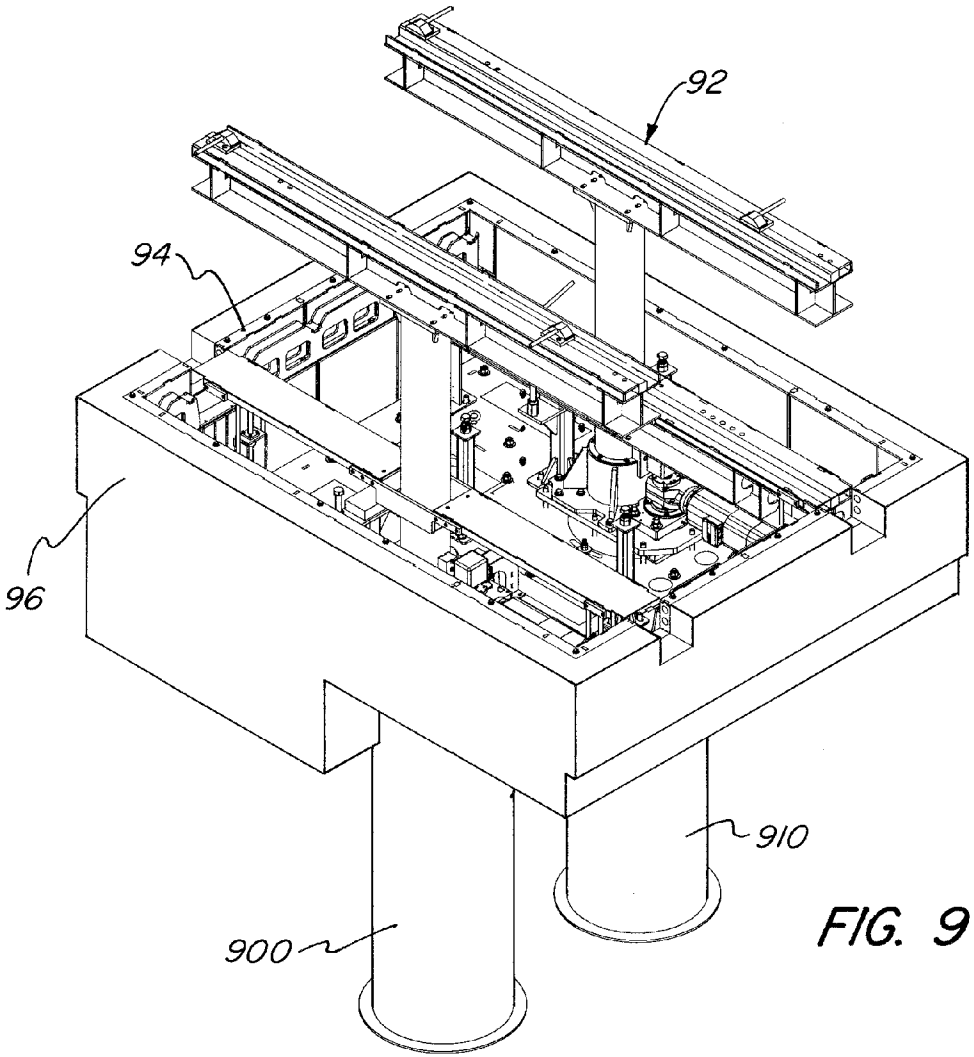
FIG. 9 is still another alternate embodiment of the frame module and machinery assembly similar to FIG. 1.

In FIG. 8, a machinery 82 has 8 columns and 8 pit members 810, 820, 830, 840 etc extending below the base of the frame module 84. The frame module and machinery 82 may be installed in a foundation similar to the preceding figures and description. In FIG. 9, machinery 92 has two columns that extend into pit members 900 and 910. The foundation 96 is disposed around the frame module 94, and portions of the frame module 94 may be submerged within the foundation to secure the frame module to the foundation. When pouring the foundation, one or more pour holes 822 may be used to allow for foundation material to be poured there through and below the base of the foundation frame.

What is claimed is:

1. An assembly for supporting machinery comprising:

a frame module including: a base with at least one attachment location, the attachment location for receiving the machinery; and a plurality of frame members affixed to the base, wherein at least one of the frame members defines a plane parallel to a wall;

a foundation having first and second sections, wherein the first section is disposed below an outside surface of said base and the second section defines the wall;

a portion of said frame module at least partially submerged within a material that makes up said foundation;

the machinery having at least one flange for affixing said machinery to said foundation at the attachment location.

2. The assembly of claim 1 wherein each attachment location includes at least one hole for receiving a bolt there through to affix the machinery to the foundation.

3. The assembly of claim 2 further comprising a machinery hole in said base, said machinery hole adapted to receive a portion of the machinery there through.

4. The assembly of claim 3 further comprising:

a pit disposed below said machinery hole wherein at least a portion of the machinery is adapted to operate in said pit.

5. The assembly of claim 4 further comprising:

a pit member disposed below said base and extending towards a bottom of said pit to define a wall of said pit.

6. The assembly of claim 5 wherein said machinery moves along an axis passing through said machinery hole.

7. The assembly of claim 5 further comprising:

a pit base disposed at a bottom end of said pit member;

a tensioning member having first and second ends, the tensioning member attached to said frame module at the first end and said pit base at the second end to secure the pit member and the pit base to said frame module.

8. A device for installing machinery in a foundation comprising:

a base having at least one attachment location wherein the machinery is adapted to affix to the foundation at one or more of the attachment locations;

a plurality of frame members affixed to said base and adapted to at least partially submerge in the foundation, wherein at least one said frame members includes an edge defining a plane parallel to a wall of the foundation;

at least one machinery hole located in said base wherein at least a part of the machinery is adapted to insert into said machinery hole to allow part of the machinery to extend below said base.

9. The device of claim 8 further comprising:

a pit member disposed below said base for defining a wall of a pit wherein part of the machinery is adapted to insert into the pit.

10. The device of claim 8 wherein said attachment location includes a plurality of holes and the machinery is affixed to the foundation by bolts passing through the holes.

11. The device of claim 10 wherein said plurality of holes are disposed in a pattern around said machinery hole and spaced away from an edge of said machinery hole.

12. The device of claim 9 wherein said machinery moves along an axis passing through said machinery hole.

13. The device of claim 11 wherein said pit member is cylindrical.

14. The device of claim 9 further comprising:

a pit base disposed at a bottom end of said pit member;

a tensioning member having first and second ends, the tensioning member attached to said frame module at the first end and said pit base at the second end to secure the pit member and the pit base to said frame module.

15. The device of claim 8 further comprising:

at least one electrical wiring affixed to at least one of the frame members, the wiring for connecting the machinery to a controller.

16. The device of claim 15 wherein each electrical wiring has two ends, each end having a releasable connection for connection of the machinery at one end and the controller at the other end.

17. A method of installing machinery, the method comprising:

providing a frame module defining an opening and a wall, the frame module sized to receive at least part of the machinery therein, the frame module including a plurality of attachment locations;

excavating a hole in the ground, the hole sized to receive the frame module;

pouring a foundation material so that said foundation material is disposed below the frame module and around the opening;

affixing the machinery to the foundation at the attachment locations.

18. The method of claim 17 wherein the frame module includes at least one machinery hole and the method further comprises:

providing a pit member and securing said pit member below the machinery hole;

wherein said excavating step includes excavating the hole so that the hole is sized to receive the pit member;

wherein said pouring step includes pouring foundation material around the pit member.

19. The method of claim 17 wherein each attachment location includes at least one hole for receiving a bolt there through to affix the machinery to the foundation.

20. The method of claim 18 wherein said step of providing and securing a pit member further comprises:

providing a pit base at a bottom end of said pit member;

providing a tensioning member having first and second ends;

attaching the tensioning member said frame module at the first end and said pit base at the second end;

tensioning said tensioning member to secure the pit member to the frame module.

21. The method of claim 18 wherein said step of pouring a foundation material further comprises:

pouring a first section of the foundation below and around the pit member;

pouring a second section of the foundation between the first section and the base.

22. The method of claim 21 further comprising: securing a form member to a frame member of said frame module to define a surface corresponding to the wall of the foundation.

23. The method of claim 17 wherein the frame module is provided with electrical wiring affixed thereto; and the method further comprises the step of connecting the machinery to the electrical wiring.

24. The method of claim 23 wherein the machinery includes a plurality of motors, and the electrical wiring includes at least one connection for each of the plurality of motors.

25. The method of claim 17 wherein the frame module is provided with a drain affixed thereto, the method further comprising the step of connecting the drain to an exterior drainage.

* * * * *